US010293501B2

(12) United States Patent
Lau

(10) Patent No.: US 10,293,501 B2
(45) Date of Patent: May 21, 2019

(54) SELF-HAIR CLIPPER

(71) Applicant: Heroka Industries Ltd., Kowloon (HK)

(72) Inventor: Shuwong Lau, Kowloon (HK)

(73) Assignee: HEROKA INDUSTRIES LTD., Hong Kong (CN)

( * ) Notice: Subject to any disclaimer, the term of this patent is extended or adjusted under 35 U.S.C. 154(b) by 0 days.

(21) Appl. No.: 15/315,920

(22) PCT Filed: Jun. 3, 2014

(86) PCT No.: PCT/CN2014/079083
§ 371 (c)(1),
(2) Date: Dec. 2, 2016

(87) PCT Pub. No.: WO2015/184585
PCT Pub. Date: Dec. 10, 2015

(65) Prior Publication Data
US 2017/0106547 A1 Apr. 20, 2017

(51) Int. Cl.

| | |
|---|---|
| ***B26D 1/00*** | (2006.01) |
| ***B26D 5/20*** | (2006.01) |
| ***B26B 19/20*** | (2006.01) |
| ***B26B 19/06*** | (2006.01) |
| ***B26B 19/38*** | (2006.01) |

(52) U.S. Cl.
CPC ..... *B26B 19/20* (2013.01); *B26B 19/06* (2013.01); *B26B 19/3853* (2013.01); *B26B 19/3873* (2013.01)

(58) Field of Classification Search
CPC ..... B26B 19/06; B26B 19/20; B26B 19/3853; B26B 19/3873
USPC ..... 30/194–204, 233.5
See application file for complete search history.

(56) References Cited

U.S. PATENT DOCUMENTS

| | | | | |
|---|---|---|---|---|
| 4,845,852 A * | 7/1989 | Sukow | B26B 19/20 30/132 |
| 5,367,772 A | 11/1994 | Ogawa | |
| 6,276,060 B1 * | 8/2001 | Faulstich | B26B 19/20 30/34.1 |
| 6,279,234 B1 * | 8/2001 | Chaouachi | B26B 19/20 30/200 |

(Continued)

FOREIGN PATENT DOCUMENTS

| | | |
|---|---|---|
| CN | 1460053 A | 12/2003 |
| CN | 201224119 Y | 4/2009 |

(Continued)

OTHER PUBLICATIONS

Chinese Office Action for Chinese Application No. 201410591541.6 dated Feb. 24, 2018.

(Continued)

*Primary Examiner* — Ghassem Alie
*Assistant Examiner* — Bharat C Patel
(74) *Attorney, Agent, or Firm* — Fay Sharpe LLP

(57) ABSTRACT

A self-hair clipper includes a housing (1), a motor (29) in the housing (1) for driving a blade (18); and a comb adjusting mechanism that forms a space for receiving the motor (29) therein, the comb adjusting mechanism includes two cam wheels (3), and wherein the motor (29) is positioned between the two cam wheels (3).

8 Claims, 9 Drawing Sheets

(56) References Cited

U.S. PATENT DOCUMENTS

| | | | | |
|---|---|---|---|---|
| 7,100,286 | B2 * | 9/2006 | Nakakura | B26B 19/20 30/201 |
| 7,438,202 | B2 * | 10/2008 | Gross | A45D 27/06 222/214 |
| 7,698,822 | B2 * | 4/2010 | Kostner | B26B 19/063 30/200 |
| 8,341,846 | B1 | 1/2013 | Holmes | |
| 2005/0246902 | A1 * | 11/2005 | Poran | B26B 19/20 30/201 |
| 2013/0263457 | A1 * | 10/2013 | Sobagaki | B26B 19/205 30/201 |
| 2017/0072577 | A1 * | 3/2017 | Darwinkel | B26B 19/20 |
| 2017/0129113 | A1 * | 5/2017 | Vonk | B26B 19/388 |

FOREIGN PATENT DOCUMENTS

| | | | |
|---|---|---|---|
| CN | 201432312 | Y | 3/2010 |
| CN | 201913662 | U | 8/2011 |
| CN | 102325476 | A | 1/2012 |
| CN | 202225230 | U | 5/2012 |
| CN | 202292822 | U | 7/2012 |
| CN | 202753182 | U | 2/2013 |
| CN | 202934594 | U | 5/2013 |
| CN | 203557404 | U | 4/2014 |
| CN | 203579701 | U | 5/2014 |
| KR | 100576168 | B1 | 5/2006 |

OTHER PUBLICATIONS

International Search Report from PCT/CN2014/079083 dated Dec. 10, 2015.

* cited by examiner

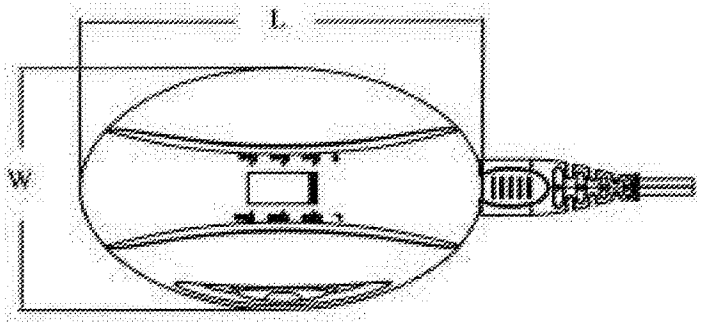
FIG. 4A
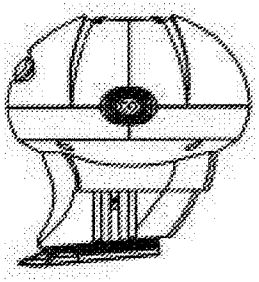
FIG. 4B
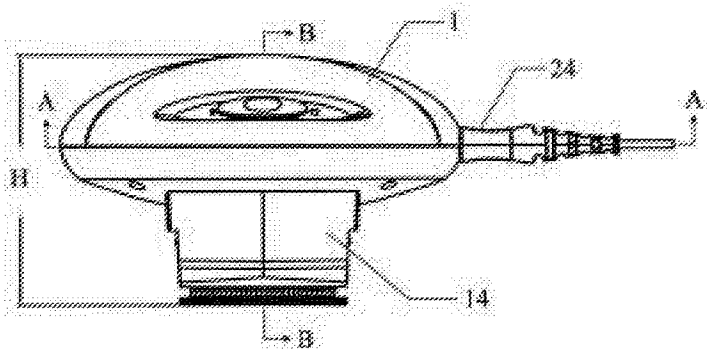
FIG. 4C
FIG. 4D
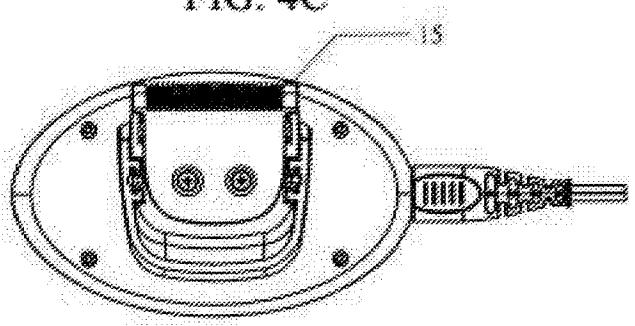
FIG. 4E

SELF-HAIR CLIPPER

This application is a 371 of PCT Application Ser. No. PCT/CN2014/079083, filed Jun. 3, 2014.

TECHNICAL FIELD

The present invention relates to a self-hair clipper.

RELATED ART

Self-hair clippers are widely used to cut one's hair by oneself. Three manufacturers (Babyliss, Philips and Remington) of self-hair clipper are widely-known at present.

One kind of self-hair clipper manufactured by Babyliss has a circular blade and a round shape. Such self-hair clipper is easy to handle, but is useful in only one way or limited portion, does not have good shaving effect and is too big with blocked vision. One kind of self-hair clipper manufactured by Philips has pivotal handle with unidirectional blade. One kind of self-hair clipper manufactured by Remington comprises reciprocating blades and has poor cutting effect.

Self-hair clippers of the prior art are not compact in size, causing these self-hair clippers to be big in size. Due to such big size, these self-hair clippers are usually difficult to handle. In some self-hair clippers of the prior art, power of the motor is transmitted to the blade via complex mechanisms, which leads to high cost and low transmission efficiency. For some self-hair clippers of the prior art, cut hair accumulates on a comb and thus baffles cutting operation.

SUMMARY

Technical Problem

Self-hair clippers of the prior art are not compact in size. The present invention aims to provide a self-hair clipper, which is compact in size and has good shaving effect.

Solution to Problem

In the first aspect of the present invention, a self-hair clipper includes a motor for driving a blade; and a comb adjusting mechanism that forms a space for receiving the motor therein, the comb adjusting mechanism includes two cam wheels, and wherein the motor is positioned between the two cam wheels.

In the second aspect of the present invention, the motor is obliquely positioned between the two cam wheels.

In the third aspect of the present invention, the comb adjusting mechanism further comprises: a comb control that includes a rack; and a slider that includes two separated holders for supporting the two cam wheels, respectively, each of the two cam wheels includes a cam and a gear integrally formed, gears of the cam wheels engages with teeth of the rack of the comb control, the space for receiving the motor is formed between the two holders.

In the fourth aspect of the present invention, the self-hair clipper further includes a comb for controlling hair length during cutting; the slider includes two separated attaching legs extending downwardly for fixing the slider to the comb.

In the fifth aspect of the present invention, the two cam wheels rotate synchronously in the same direction when the comb control is actuated.

In the sixth aspect of the present invention, the rack has a gear modulus m of 0.5, a pitch circle diameter of 184 mm, a number of teeth of 368 and a gear pitch t of 1.57 mm, the gear of the cam wheel has a gear modulus m of 0.5, a pitch circle diameter of 15 mm, a number of teeth of 30 and a gear pitch t of 1.57 mm.

In the seventh aspect of the present invention, a self-hair clipper includes a cutter that projects towards a projection side of the self-hair clipper for cutting hair; and a housing that defines a space to receive components of the self-hair clipper therein, the housing includes two surfaces adjacent to the cutter, the two surfaces are tilted towards a side of the self-hair clipper opposite to the projection side at an obtuse angle.

In the eighth aspect of the present invention, the obtuse angle is 153 degrees.

Advantageous Effect of Invention

The self-hair clipper according to the present invention is compact in size and has good shaving effect.

BRIEF DESCRIPTION OF THE DRAWINGS

Exemplary embodiments of the present invention will be described in detail based on the following figures, wherein:

FIG. 2A is a top view thereof, FIG. 2B is a right view thereof, FIG. 2C is a front view thereof, FIG. 2D is a left view thereof and FIG. 2E is a bottom view thereof;

FIGS. 4A-4E are elevation views of the self-hair clipper, wherein the comb is detached, FIG. 4A is a top view thereof, FIG. 4B is a right view thereof, FIG. 4C is a front view thereof, FIG. 4D is a left view thereof and FIG. 4E is a bottom view thereof;

DETAILED DESCRIPTION

Figure 1:
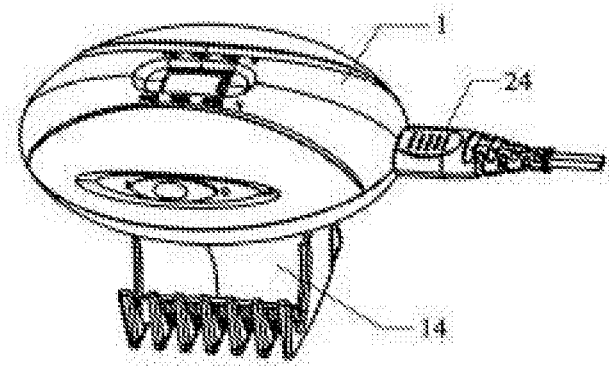
FIG. 1 is a perspective view of a self-hair clipper according to a first exemplary embodiment of the present invention, wherein the comb is attached.
Figure 2A:
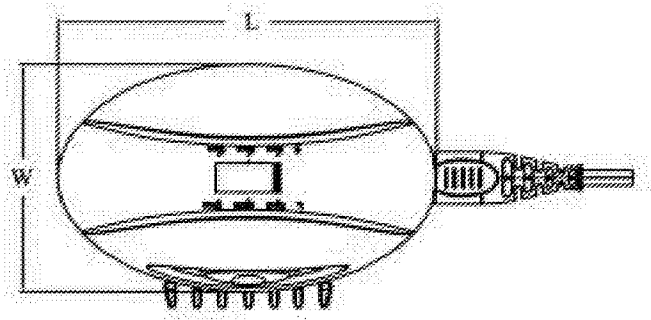
FIGS. 2A-2E are elevation views of the self-hair clipper, wherein the comb is attached.
Figure 2D:
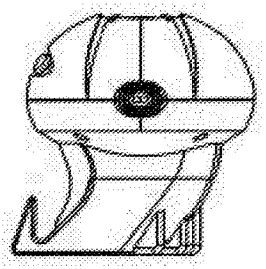
Figure 2B:
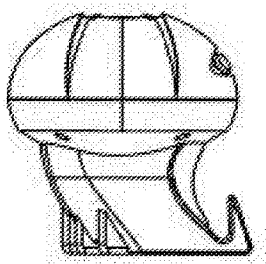
Figure 2C:
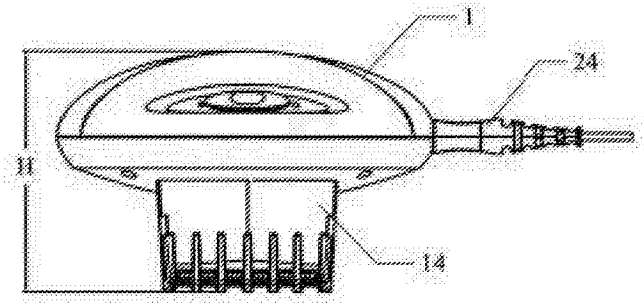
Figure 2E:
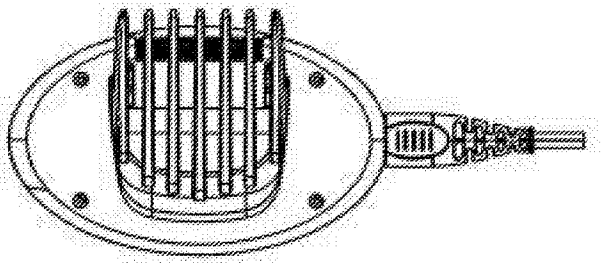
Figure 3:
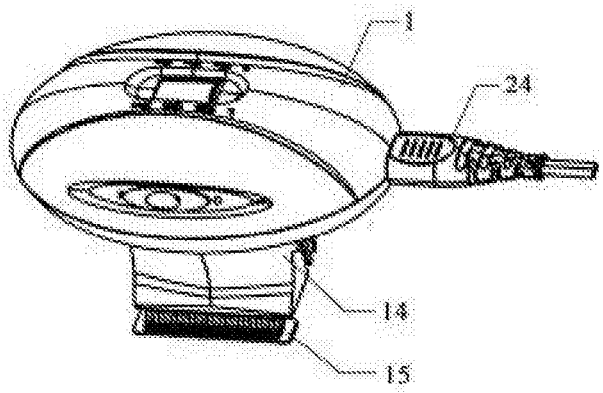
FIG. 3 is a perspective view of the self-hair clipper, wherein the comb is detached.

Exemplary embodiments of the present invention will be described in detail below with reference to the accompanying drawings. In the accompanying drawings, like parts are indicated by like reference numerals.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary embodiments of the invention. Hence, specific dimensions and other physical characteristics related to the embodiments disclosed herein are not to be considered as limiting.

In order for ease of description, a self-hair clipper is placed in such an orientation that a comb is located at a lower side of the self-hair clipper, an adapter 24 is located at a right side of the self-hair clipper, and a switch is located at a front side of the self-hair clipper, as shown in FIG. 2. Such orientation is merely used for illustrate the self-hair clipper, the self-hair clipper is not limited to such orientations.

The self-hair clipper mainly includes a housing, an electric unit, a hair cutting mechanism and a comb adjusting mechanism.

As shown in FIGS. 1-4E, the housing includes a top housing 1 and a bottom housing 14 assembled together to define a space to receive other components therein.

The top housing 1 and the bottom housing 14 are typically formed of plastics, and preferably formed of ABS. Material of the housing is not limited to plastics and can be any suitable material known for a person skilled in the art.

Figure 5B:
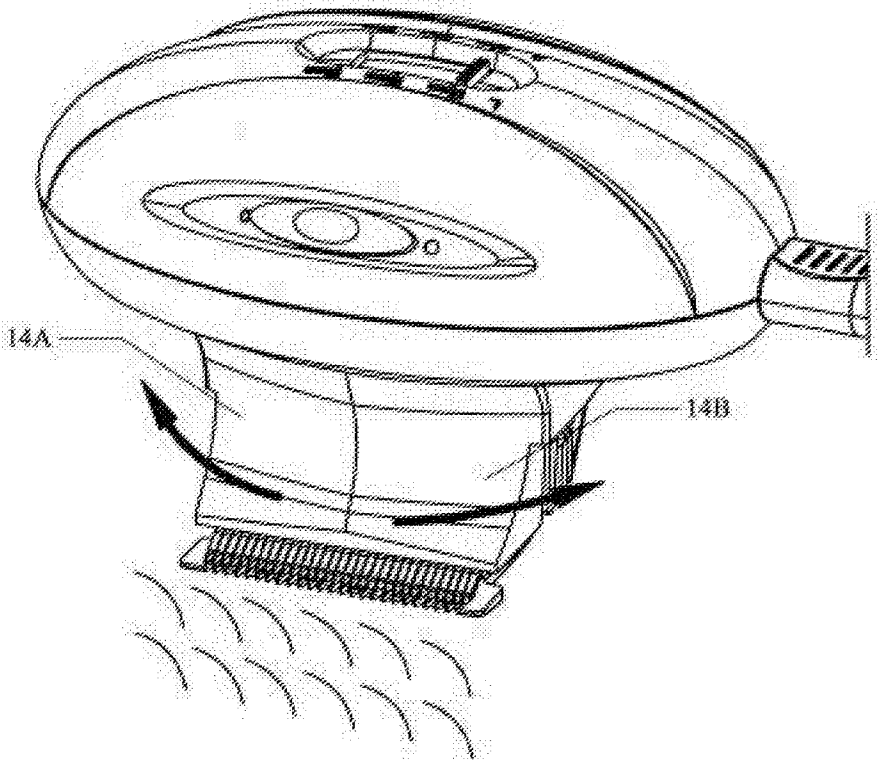
FIGS. 5A and 5B are partly cutaway view and enlarged perspective view of the self-hair clipper, respectively.
Figure 5A:
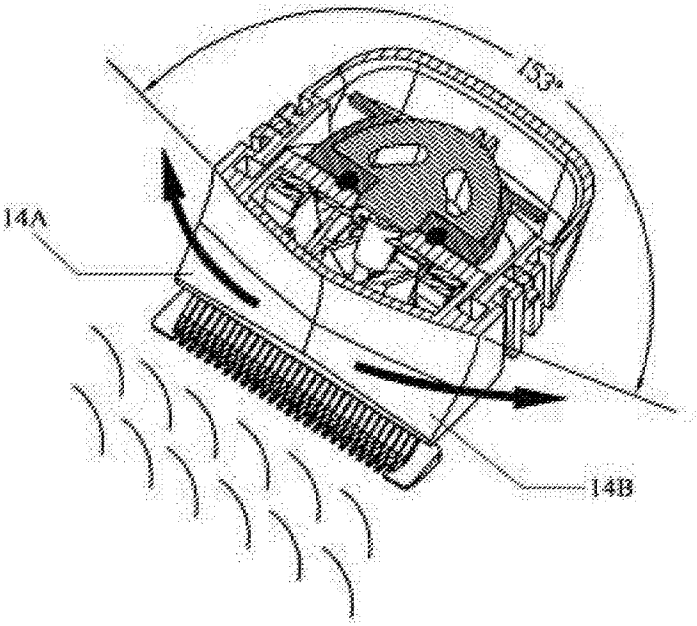

As shown in FIGS. 5A and 5B, the bottom housing 14 includes front surfaces 14A and 14B adjacent to and above a cutter formed by a moving blade 18 and a fixed blade 17. The surfaces 14A and 14B are surfaces facing towards projecting direction of the cutter of the self-hair clipper. The surfaces 14A and 14B are tilted towards a rearward direction and form an obtuse angle $\alpha$. The obtuse angle formed by the surfaces 14A and 14B is flared towards a side of the self-hair clipper opposite to a cutter side (in this embodiment, the front side). The cutter side is also referred to as a projection side of the self-hair clipper where the cutter projects for cutting hair. In other words, the obtuse angle formed by the surfaces 14A and 14B points to the cutter side (in this embodiment, the front side). That is, intersecting portion formed by the surfaces 14A and 14B is closer to the cutter side (in this embodiment, the front side) than other portion of the surfaces 14A and 14B.

In this way, cut hair is automatically pushed towards the left and right sides during cutting operation, thereby avoiding cut hair from accumulating on the comb.

The angle $\alpha$ is preferably in a range of 130 to 170 degrees, more preferably in a range of 140 to 160 degrees, and most preferably 153 degrees.

As shown in FIGS. 2A-2E and 4A-4E, in an example, the self-hair clipper has a length A of 112 mm, a width W of 68 mm and a height H of 70 mm.

Size of the self-hair clipper is not limited to the size mentioned above and can be any size as required.

Figure 6:
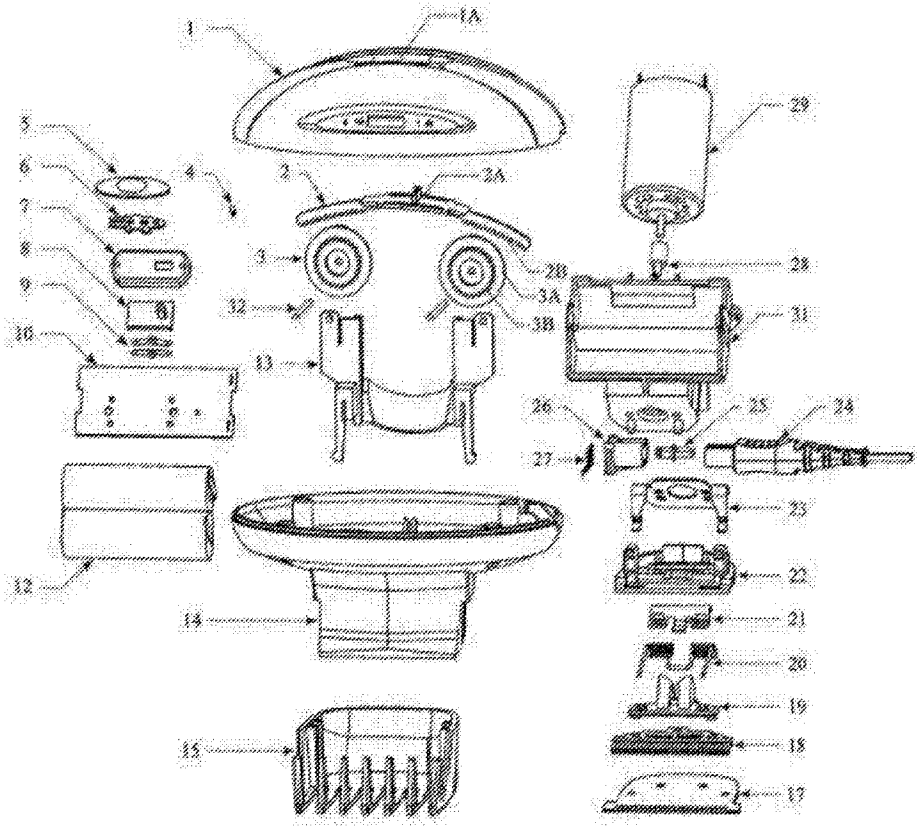
FIG. 6 is an explosive view of the self-hair clipper illustrating components thereof.

As shown in FIG. 6, in an embodiment, the electric unit mainly includes the adapter 24, a charging pin 25, a bracket charging pin 26, a contact plate 27, a LED lens 4, a switch cap 5, a switch lock 6, a switch housing 7, a switch cover 8, two contact plate switches 9, a PCB board 10 and a battery 12. The switch is used to switch on/off the self-hair clipper. The LED lens 4 indicates on/off of the self-hair clipper. Number of the battery 12 is usually two, but is not limited in any way.

The adapter 24 is used to connect to external power supply for supplying power to the self-hair clipper. The battery 12 is also used to supply power for the self-hair clipper. The self-hair clipper can be supplied with power by the battery 12 or via the adapter 24.

Figure 8B:
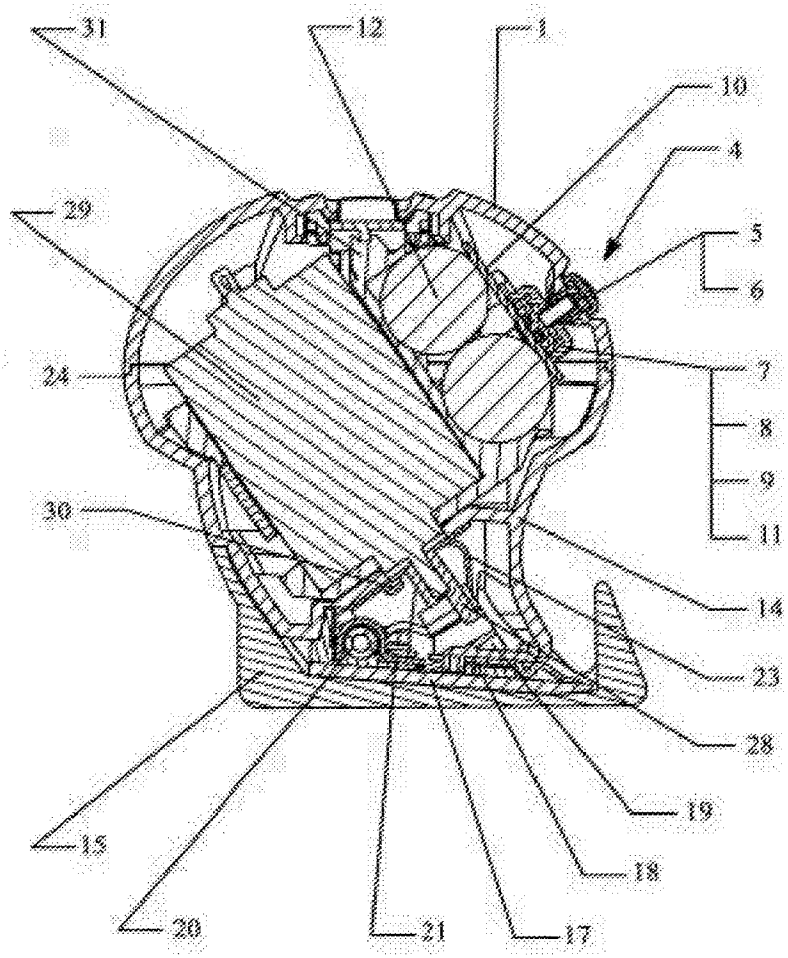
FIGS. 8A and 8B are sectional views of the self-hair clipper along the lines A and B in FIG. 4C, illustrating positional relationship among the motor, the motor bracket, the comb control, the cam wheel and the slider.
Figure 8A:
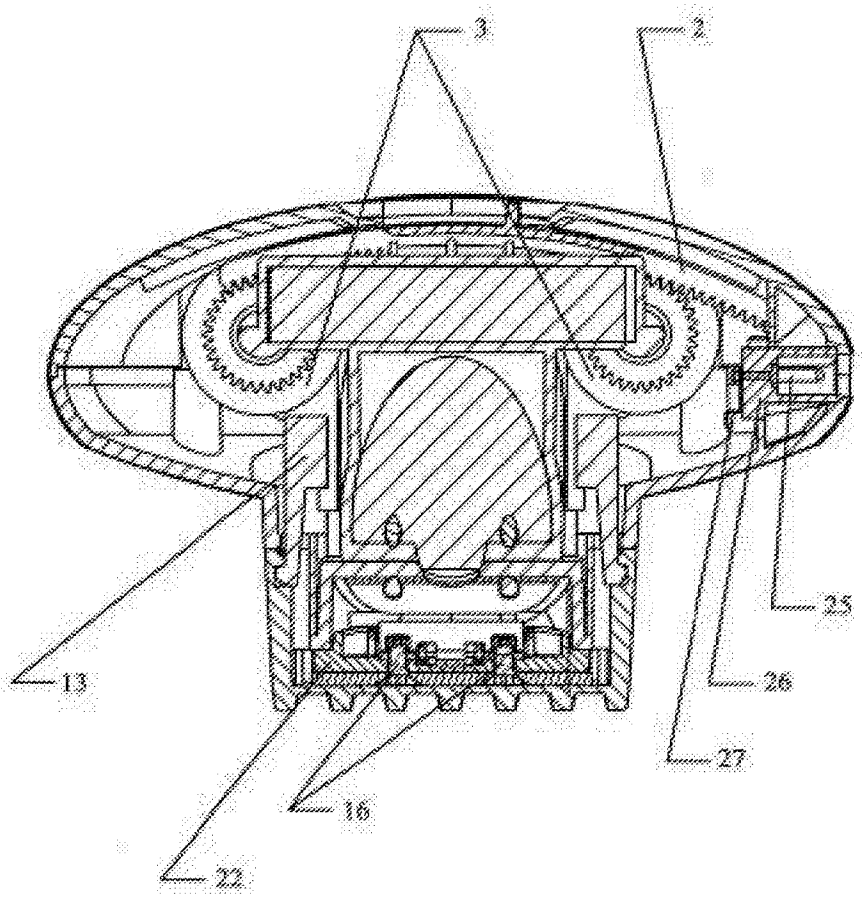
Figure 9A:
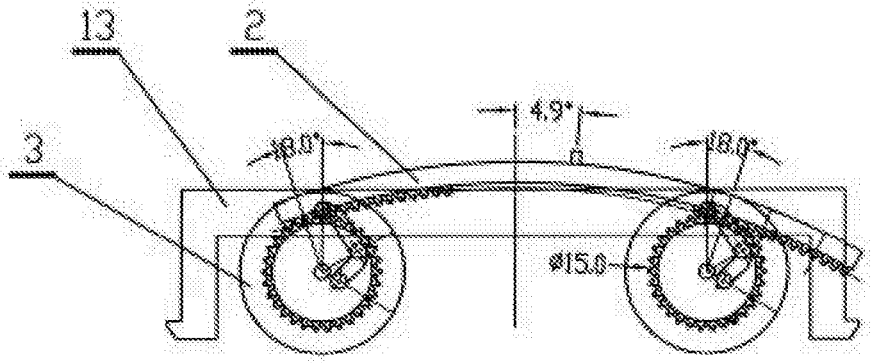
FIGS. 9A-9C are exemplary views of an example illustrating movement of the comb control, the cam wheel and the slider.
Figure 9B:
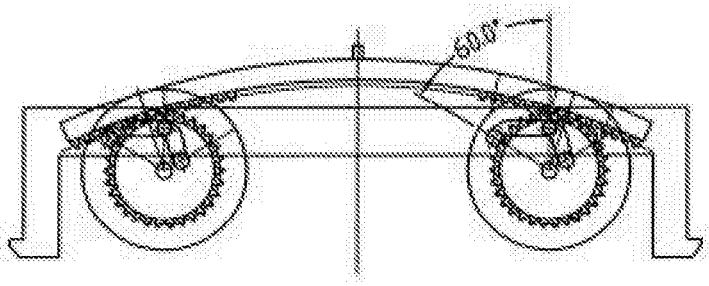
Figure 9C:
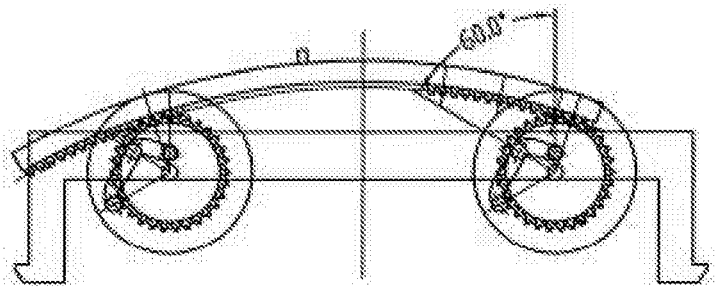

As shown in FIGS. 6 and 8A-8B, in an embodiment, the hair cutting mechanism mainly includes a motor 29, an eccentric 28 connected with a shaft of the motor 29, a motor bracket 31 for holding the motor 29, a lock spring plate 23, the moving blade 18, the fixed blade 17, a plate 21, a blade spring 20, a fixed blade bracket 22 for holding the fixed blade 17 and a moving blade holder 19 for holding the moving blade 18. Both the motor 29 and the battery 12 are mounted on the motor bracket 31. Both the moving blade 18 and the fixed blade 17 are formed with cutting teeth on the cutting edges (in this embodiment, the front edges) thereof.

During cutting operation, the comb 15 usually contacts a user's skin. When the comb 15 is adjusted to contact with the moving blade 18, there does not exist a gap between the comb 15 and the moving blade 18. Then, hair will be totally cut without remaining hair. When the comb 15 is adjusted to be distant from the moving blade 18, there exists a gap between the comb 15 and the moving blade 18. Then, hair will not be totally cut, but remains to have a length corresponding to the gap.

The motor 29 drives the moving blade 18 to move reciprocally via the eccentric 28, so as to cut hair together with the fixed blade 17.

In the embodiment, the motor 29 is disposed adjacent to the cutter and drives the moving blade 18 to move reciprocally merely via the eccentric 28. No other transmission mechanism exists between the motor 29 and the moving blade 18 in the embodiment. Thus, the cost is low and the transmission efficiency is high.

Structure of the hair cutting mechanism in the above embodiment is merely exemplary, and some parts may be omitted as required.

The comb adjusting mechanism mainly includes the comb control 2, two cam wheels 3 and the slider 13.

The slider 13 is mounted in the housing in such a manner that the slider 13 can move upwardly and downwardly in a vertical direction and formed to be substantially "H" shape. The slider 13 includes two separated attaching legs extending downwardly for fixing the slider 13 to the comb 15 and two separated holders extending upwardly for supporting the two cam wheels 3. On each holder of the slider 13 is formed a pin which engages in a slot formed in the corresponding cam wheel 3.

Figure 7B:
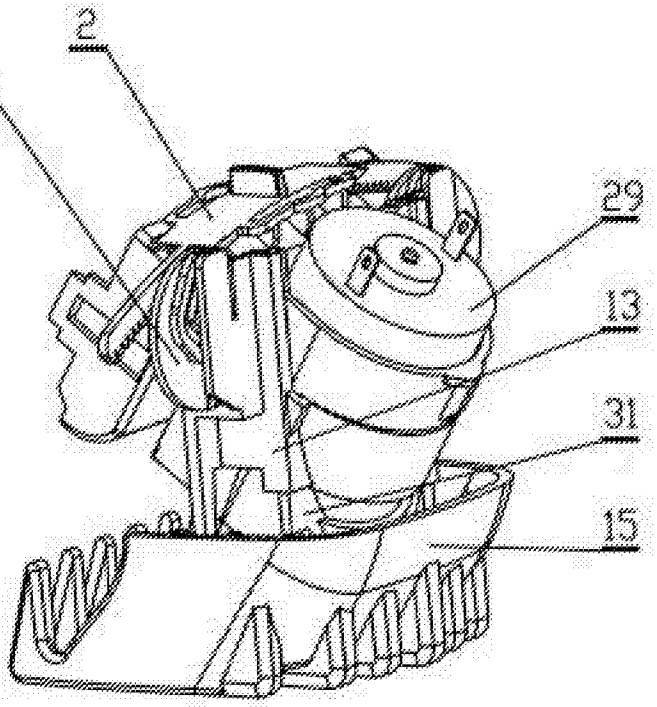
FIGS. 7A and 7B are partial views of the self-hair clipper illustrating positional relationship among a motor, a motor bracket, a comb control, a cam wheel and a slider.
Figure 7A:
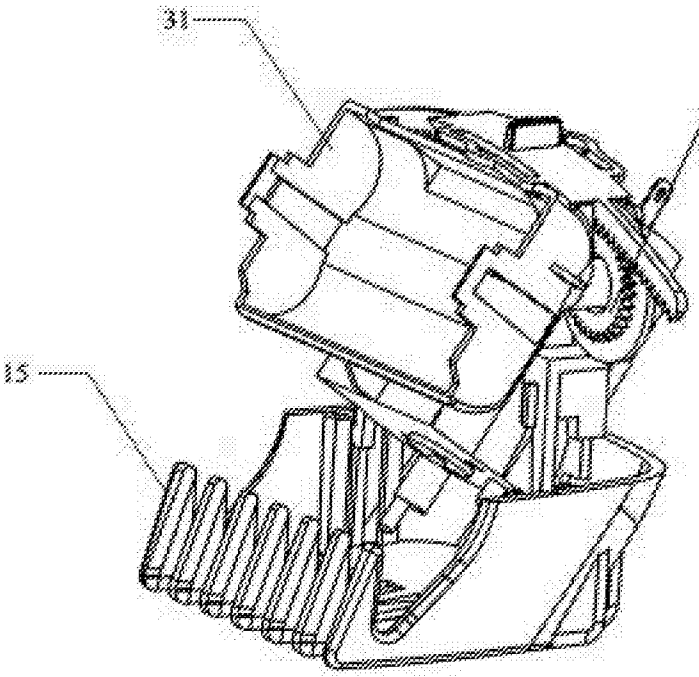

As shown in FIGS. 6 and 7A-7B, the two holders form a space of substantially "U" shape. That is, the comb adjusting mechanism (including the comb control 2, two cam wheels 3 and the slider 13) forms a space of substantially "O" shape. The motor 29 is positioned between the two cam wheels 3. That is, the motor 29 is obliquely mounted in the space between the two holders. The motor 29 is located at an angle with respect to the plane of the cutter. The battery is located in front of the cam wheels 3 and the comb control 2. In this way, space of the self-hair clipper is used efficiently, and thus structure of the self-hair clipper is compact and size thereof is reduced.

The shape of the space formed by the comb adjusting mechanism is not limited to "O" shape, but can be any other shape suitable to receive the motor therein.

The above configuration of the comb adjusting mechanism is merely exemplary. The comb adjusting mechanism is not limited to such configuration in any way, but can adopt other configuration suitable for the self-hair clipper as long as the comb adjusting mechanism forms a space for receiving the motor and the motor 29 can be obliquely mounted in the space.

The comb control 2 includes a rack 2B and a protrusion 2A which is formed on an upper side of the comb control 2 and protrudes outside of the top housing 1 from an opening 1A formed in the top of the top housing 1. The protrusion 2A of the comb control 2 is preferably formed at a middle portion of the rack 2B.

The comb control 2 follows an inner profile of a portion of the top housing 1 corresponding to and above the comb control 2. Thus, the comb control 2 is preferably curved. The comb control 2 is mounted in the housing in such a manner that the comb control 2 can move towards a first side and a second side, which are the left and right sides in FIG. 6.

Teeth of the rack 2B are formed on a lower side of the comb control 2. In an example, the rack 2B has a gear modulus m of 0.5, a pitch circle diameter of 184 mm, a number of teeth of 368 and a gear pitch t of 1.57 mm.

The cam wheel 3 includes a cam 3A and a gear 3B which are integrally formed and is rotatablely mounted in the housing so that the cam wheel 3 can rotate about a rotation axis.

The gear 3B of the cam wheel 3 is engaged with the teeth of the comb control 2.

In an example, the gear of the cam wheel 3 has a gear modulus m of 0.5, a pitch circle diameter of 15 mm, a number of teeth of 30 and a gear pitch t of 1.57 mm.

When the comb control 2 is pushed to move, the left and right cam wheels 3 rotate synchronously in the same direction. Specifically, when the comb control 2 is pushed to move towards the first or left side, the left and right cam wheels 3 rotate synchronously in an anticlockwise direction. When the comb control 2 is pushed to move towards the second or right side, the left and right cam wheels 3 rotate synchronously in a clockwise direction.

Since the pins formed on the slider 13 engage in the slots formed in the cam 3A of the cam wheel 3 in such a manner that the pins are slidable in the slots, the slider 13 will move upwardly and downwardly when the cam wheel 3 rotates.

As an alternative, the pin can be formed on the cam wheel 3 and the slot can be formed in the slider 13.

As to shape of the slot, for example, the slot can be formed in such a shape that it approaches center of the cam 3B when it extends circumferentially around the center from one end to the other end in a clockwise direction. As an alternative, the slot can be formed in such a shape that it moves away from the center of the cam 3B when it extends circumferentially around the center from one end to the other end in a clockwise direction. The above-mentioned shape of the slot is merely exemplary. The shape of the slot is not limited, but can be set by a person skilled in the art as required.

For example, when the comb control 2 is pushed to move by 4.9 degrees toward the first or left side, the rack 2B of the comb control 2 is moved by a distance of six teeth, and thus the cam wheel 3 rotates by a distance of six teeth, that is rotates by 60 degrees. At this time, engagement of the pin and the slot causes the slider 13 to move downwardly by 3 mm in a vertical direction. Since the comb 15 is fixedly attached to the slider 13, the comb 15 also moves downwardly by 3 mm in a vertical direction.

When the comb control 2 is further pushed to move by 4.9 degrees towards the first or left side, the cam wheel 3 further rotates by 60 degrees. Thus, the slider 13 further moves downwardly by 3 mm in a vertical direction. The comb 15 also further moves downwardly by 3 mm in a vertical direction.

In the above embodiment, when the comb control 2 is pushed to move towards the first or left side, the slider 13 moves downwardly in a vertical direction. When the comb control 2 is pushed to move toward the second or right side, the slider 13 moves upwardly in a vertical direction.

In another embodiment, when the comb control 2 is pushed to move toward the first or left side, the slider 13 moves upwardly in a vertical direction. When the comb control 2 is pushed to move toward the second or right side, the slider 13 moves downwardly in a vertical direction.

An indicia indicating adjustment direction of the remaining hair length can be formed on the top housing near the protrusion 2A of the comb control 2, so that a user can easily know in which direction he pushes the protrusion 2A to increase or decrease the remaining hair length even if he uses the self-hair clipper at the first time. For example, a solid or hollow line with different widths at two ends thereof can be used as the indicia, which indicates that remaining hair after cutting is long when the protrusion 2A is located at one end marked with thicker line, and indicates that remaining hair after cutting is short when the protrusion 2A is located at the other end marked with thinner line. As another example, characters, such as "long" and "short" can be simply marked to be used as the indicia.

Besides, by selectively using a small comb 15 or a big comb 15, it is possible to control hair cutting length to be 3 mm, 6 mm, 9 mm, 12 mm, 16 mm and 18 mm.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. For instance, features illustrated or described as part of one embodiment can be used on another embodiment in any combination desired to yield a further embodiment. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A self-hair clipper including:

a motor for driving a blade; and an adjusting mechanism for an associated comb, wherein the adjusting mechanism defines a space for receiving the motor therein, and wherein the adjusting mechanism comprises:

two cam wheels, wherein the motor is positioned between the two cam wheels, and wherein each cam wheel includes a cam and a gear integrally formed;

a comb control that includes a rack, the rack having teeth; and a slider that includes two separated holders for supporting the two cam wheels;

wherein the gears of the two cam wheels engage the teeth of the rack of the comb control, and the space for receiving the motor is formed between the two holders.

2. The self-hair clipper according to claim 1, wherein the motor is obliquely positioned between the two cam wheels.

3. The self-hair clipper according to claim 1, further including:

a comb for controlling hair length during cutting;

the slider includes two separated attaching legs extending downwardly for fixing the slider to the comb.

4. The self-hair clipper according to claim 3, wherein the two cam wheels rotate synchronously in the same direction when the comb control is actuated.

5. The self-hair clipper according to claim 1, wherein the two cam wheels rotate synchronously in the same direction when the comb control is actuated.

6. The self-hair clipper according to claim 1, wherein the rack has a gear modulus (m) of 0.5, a pitch circle diameter of 184 mm, a number of teeth of 368 and a gear pitch (t) of 1.57 mm, the gear of the cam wheel has a gear modulus (m) of 0.5, a pitch circle diameter of 15 mm, a number of teeth of 30 and a gear pitch (t) of 1.57 mm.

7. The self-hair clipper according to claim 1, wherein the blade projects towards a projection side of the self-hair clipper for cutting hair; and the self-hair clipper further includes a housing that defines a space to receive components of the self-hair clipper therein, characterized in that the housing includes two surfaces adjacent to the blade, the two surfaces are tilted towards a side of the self-hair clipper opposite to the projection side at an obtuse angle.

8. The self-hair clipper according to claim 7, wherein the obtuse angle is 153 degrees.

* * * * *